US011360428B2

(12) United States Patent
Pettingill et al.

(10) Patent No.: US 11,360,428 B2
(45) Date of Patent: Jun. 14, 2022

(54) PHOTOCONDUCTOR HAVING OPTICAL TAG

(71) Applicant: HEWLETT-PACKARD DEVELOPMENT COMPANY, L.P., Spring, TX (US)

(72) Inventors: Justin Pettingill, Boise, ID (US); Gabriel McDaniel, Boise, ID (US); Juan Guzman, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/309,412

(22) PCT Filed: Jul. 9, 2019

(86) PCT No.: PCT/US2019/040976
§ 371 (c)(1),
(2) Date: May 26, 2021

(87) PCT Pub. No.: WO2021/006880
PCT Pub. Date: Jan. 14, 2021

(65) Prior Publication Data

US 2022/0035310 A1 Feb. 3, 2022

(51) Int. Cl.

| | |
|---|---|
| ***G03G 15/00*** | (2006.01) |
| ***G03G 21/18*** | (2006.01) |
| ***G03G 5/047*** | (2006.01) |

(52) U.S. Cl.
CPC ..... *G03G 21/1896* (2013.01); *G03G 5/047* (2013.01); *G03G 15/5033* (2013.01); *G03G 15/751* (2013.01); *G03G 21/1875* (2013.01)

(58) Field of Classification Search
CPC ..... G03G 15/751; G03G 15/757; G03G 21/1671; G03G 21/1896; G03G 5/047; G03G 5/142; G03G 5/14708; G03G 15/5033; G03G 21/1875
See application file for complete search history.

(56) References Cited

U.S. PATENT DOCUMENTS

| | | | | |
|---|---|---|---|---|
| 6,128,448 | A | 10/2000 | Arcaro et al. | |
| 6,246,847 | B1 | 6/2001 | Jeong | |
| 6,278,854 | B1 * | 8/2001 | Handa | G03G 15/751 399/111 |
| 7,448,734 | B2 | 11/2008 | Silverbrook et al. | |
| 7,477,864 | B2 | 1/2009 | Daniels et al. | |
| 7,929,163 | B2 | 4/2011 | Park et al. | |
| 2006/0062583 | A1 * | 3/2006 | Kikuchi | G03G 21/1889 399/24 |
| 2009/0220875 | A1 | 9/2009 | Toshine | |

(Continued)

FOREIGN PATENT DOCUMENTS

| | | | | |
|---|---|---|---|---|
| EP | 0730207 | A1 * | 9/1996 | G03G 15/751 |
| EP | 0665472 | B1 | 8/1999 | |

(Continued)

*Primary Examiner* — Sophia S Chen
(74) *Attorney, Agent, or Firm* — Trop Pruner & Hu, P.C.

(57) ABSTRACT

An organic photoconductor includes a cylindrical body having a surface on which an electrostatic latent image is to be formed, and an optical tag provided on an outer circumferential surface of the cylindrical body. The organic photoconductor may be included in a development cartridge for an image forming apparatus.

20 Claims, 9 Drawing Sheets

(56) References Cited

U.S. PATENT DOCUMENTS

| | | | | |
|---|---|---|---|---|
| 2010/0080581 | A1* | 4/2010 | Shimizu | G03G 15/757 399/36 |
| 2010/0111564 | A1 | 5/2010 | Yamashita | |
| 2012/0288291 | A1* | 11/2012 | Miyadera | G03G 15/043 399/51 |
| 2017/0262721 | A1* | 9/2017 | Richards | G03G 21/1896 |

FOREIGN PATENT DOCUMENTS

| | | | | |
|---|---|---|---|---|
| EP | 2018037 | A1 * | 1/2009 | G03G 21/1896 |
| JP | S59149339 | | 8/1984 | |

* cited by examiner

PHOTOCONDUCTOR HAVING OPTICAL TAG

BACKGROUND

An image forming apparatus using an electrophotographic method supplies toner to an electrostatic latent image formed on a photoconductor to form a visible toner image on the photoconductor, transfers the toner image to a printing medium via an intermediate transfer medium or directly to a printing medium, and then fixes the transferred toner image on the printing medium.

A development cartridge contains the toner, and supplies toner to the electrostatic latent image formed on the photoconductor to form a visible toner image.

DETAILED DESCRIPTION

Figure 1:
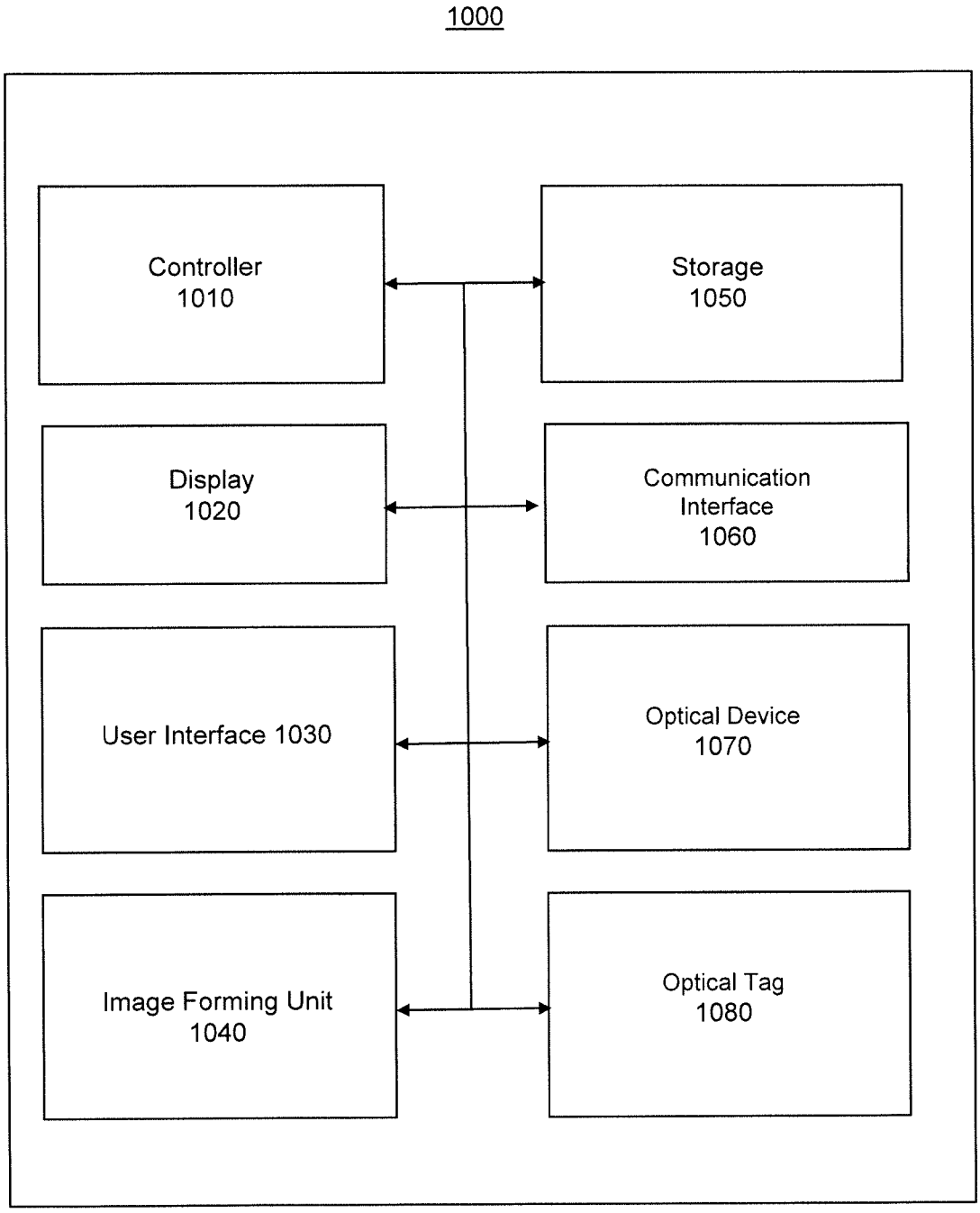
FIG. 1 is a block diagram of an image forming apparatus, according to an example.

Reference will now be made to various examples which are illustrated in the accompanying drawings. The same reference numerals are used to denote the same elements, and repeated descriptions thereof will be omitted.

Figure 2:
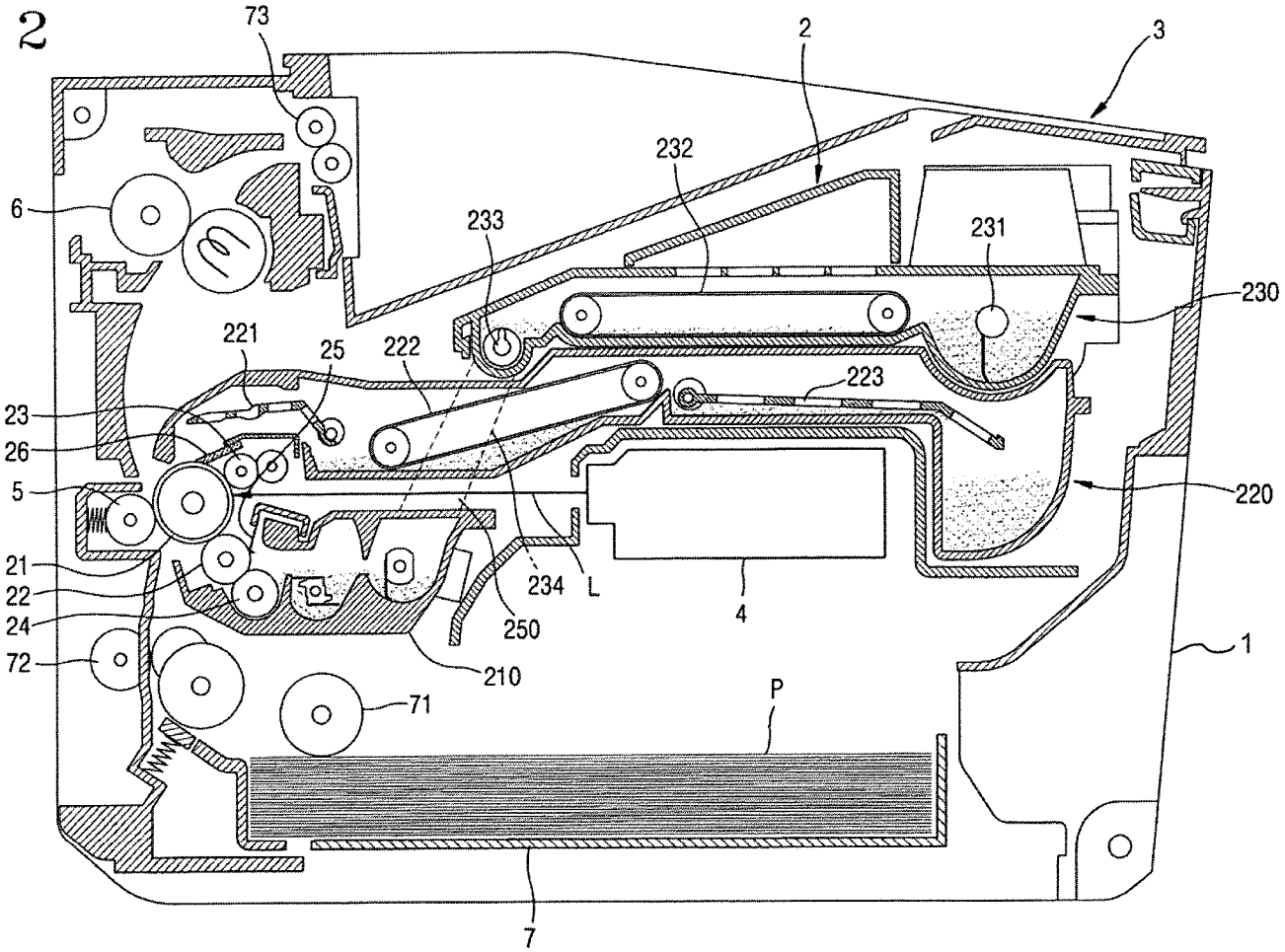
FIG. 2 is a schematic structural diagram of an image forming apparatus, according to an example.

FIG. 1 is a block diagram of an image forming apparatus according to an example. FIG. 2 is a schematic structural diagram of an image forming apparatus according to an example.

Referring to FIG. 1, the image forming apparatus 1000 may include some or all of the features shown in the image forming apparatus illustrated in FIG. 2. With reference to FIG. 1, the image forming apparatus 1000 includes a controller 1010, a display 1020, a user interface 1030, an image forming unit 1040, a storage 1050, a communication interface 1060, an optical device 1070, and an optical tag 1080. The optical tag 1080 may also be referred to as an optical strip.

The controller 1010 may execute instructions stored in the storage 1050. The controller 1010 may include, for example, a processor, an arithmetic logic unit, a central processing unit (CPU), a graphics processing unit (GPU), a digital signal processor (DSP), an image processor, a microcomputer, a field programmable array, a programmable logic unit, an application-specific integrated circuit (ASIC), a microprocessor, or combinations thereof.

The display 1020 may display information regarding the image forming apparatus 1000. The display 1020 may include a liquid crystal display (LCD), a light emitting diode (LED) display, an organic light emitting diode (OLED) display, active matrix organic light emitting diode (AMOLED), flexible display, 3D display, a plasma display panel (PDP), a cathode ray tube (CRT) display, and the like, for example. The display 1020 may also include a touchscreen to receive the user input and therefore may also be utilized as a user interface.

The user interface 1030 may receive a user input to perform an operation or function of the image forming apparatus 1000, and may provide a user with information regarding the image forming apparatus 1000. The user interface 1030 may include, for example, a keyboard (e.g., a physical keyboard, virtual keyboard, etc.), a mouse, a joystick, a button, a switch, an electronic pen or stylus, a gesture recognition sensor (e.g., to recognize gestures of a user including movements of a body part), an input sound device or voice recognition sensor (e.g., a microphone to receive a voice command), a track ball, or combinations thereof. The user interface 1030 may further include a haptic device to provide haptic feedback to a user. The user interface 1030 may also include a touchscreen, for example.

The image forming unit 1040 may perform an image forming job by forming an image on a recording medium to perform a job such as printing, copying, and faxing, for example. The image forming unit 1040 may include a print engine which receives a control signal from the controller 1010 to perform a printing operation. Further details regarding the image forming unit 1040 are discussed in relation to FIG. 2.

The storage 1050 may include, for example, machine readable storage devices which may be any electronic, magnetic, optical, or other physical storage device that stores executable instructions. For example, the storage 1050 may include a nonvolatile memory device, such as a Read Only Memory (ROM), Programmable Read Only Memory (PROM), Erasable Programmable Read Only Memory (EPROM), and flash memory, a USB drive, a volatile memory device such as a Random Access Memory (RAM), a hard disk, floppy disks, a blue-ray disk, or optical media such as CD ROM discs and DVDs, or combinations thereof.

The image forming apparatus 1000 may be connected with another device such as a laptop, personal computer, tablet, mobile phone, server, or combinations thereof, in a wired and/or wireless manner, for example through a communication interface 1060. The image forming apparatus 1000 may be connected over a network such as a local area network (LAN), wireless local area network (WLAN), wide area network (WAN), personal area network (PAN), virtual private network (VPN), or the like. For example, wireless communication between elements of the examples disclosed herein may be performed via a wireless LAN, Wi-Fi, Bluetooth, ZigBee, Wi-Fi direct (WFD), ultra wideband (UWB), infrared data association (IrDA), Bluetooth low energy (BLE), near field communication (NFC), a radio frequency (RF) signal, and the like. For example, the wired communication connection may be performed via a pair cable, a coaxial cable, an optical fiber cable, an Ethernet cable, and the like.

The optical device 1070 or optical system may scan light modulated onto the optical tag 1080 or optical strip which is provided on a surface of the organic photoconductor. Information may be read from the optical tag 1080 and/or written to the optical tag 1080 by the optical device 1070. The optical device 1070 may include a laser scanning unit (LSU) that scans or emits light radiated from a laser diode onto the optical tag 1080. The light may be deflected by using a polygon mirror, for example, provided between the optical device 1070 and the optical tag 1080. Further features of the optical device 1070 and optical tag 1080 will be discussed in more detail below.

Referring to FIG. 2, the image forming apparatus may include a main body 1 and a development cartridge 2 that is attachable to/detachable from the main body 1. A door 3 may be provided in the main body 1. The door 3 opens or closes a portion of the main body 1. The development cartridge 2 may be mounted to or removed from the main body 1 by opening the door 3.

A photosensitive drum 21 is an example of a photoconductor on which an electrostatic latent image is formed, and may include a cylindrical metal pipe and a photoconductive photosensitive layer formed on an outer circumference of the metal pipe. A charging roller 23 is an example of a charger that charges a surface of the photosensitive drum 21 to have a uniform electric potential. A charge bias voltage is applied to the charging roller 23. Instead of the charging roller 23, a corona charger (not shown) may be used. A developing roller 22 supplies toner to an electrostatic latent image formed on a surface of the photosensitive drum 21 to develop the electrostatic latent image.

In a two-component developing method in which toner and a carrier are used as a developer, the developing roller 22 may be in the form of a sleeve inside of which a magnet is fixed. The sleeve may be located apart from the photosensitive drum 21 by tens to hundreds of micrometers. The carrier is attached to an outer circumference of the developing roller 22 via a magnetic force of a magnet, and the toner is attached to the carrier via an electrostatic force, thereby forming a magnetic brush including the carrier and the toner on the outer circumference of the developing roller 22. According to a developing bias applied to the developing roller 22, the toner is moved to the electrostatic latent image formed on the photosensitive drum 21.

In a one-component developing method in which toner is used as a developer, the developing roller 22 may be in contact with the photosensitive drum 21, and may be located apart from the photosensitive drum 21 by tens to hundreds of micrometers. In the example, a one-component contact developing method in which the developing roller 22 and the photosensitive drum 21 contact each other to form a developing nip is used. The developing roller 22 may be in the form of an elastic layer (not shown) formed on an outer circumference of a conductive metal core (not shown). When a developing bias voltage is applied to the developing roller 22, the toner is moved via the developing nip, to the electrostatic latent image formed on a surface of the photosensitive drum 21 to be attached to the electrostatic latent image.

A supplying roller 24 attaches the toner to the developing roller 22. A supply bias voltage may be applied to the supplying roller 24 to attach the toner to the developing roller 22. Reference numeral 25 denotes a regulating member regulating a toner amount attached to the surface of the developing roller 22. The regulating member 25 may be, for example, a regulating blade having a front end that contacts the developing roller 22 at a certain pressure. Reference numeral 26 denotes a cleaning member used to remove residual toner and foreign substances from the surface of the photosensitive drum 21 before charging. The cleaning member 26 may be, for example, a cleaning blade having a front end that contacts the surface of the photosensitive drum 21 at a certain pressure. Foreign substances removed from the surface of the photosensitive drum 21 may be referred to as waste toner.

An optical scanner 4 scans light modulated according to image information, onto a surface of the photosensitive drum 21 charged to a uniform electric potential. As the optical scanner 4, for example, a laser scanning unit (LSU) that scans light radiated from a laser diode onto the photosensitive drum 21 by deflecting the light by using a polygon mirror, in a main scanning direction, may be used. According to an example, the optical scanner 4 may also correspond to optical device 1070 and may scan light modulated onto the optical tag 1080 or optical strip which is provided on a surface of the organic photoconductor so as to store information in the optical tag 1080 and/or to read information stored in the optical tag 1080. The optical scanner 4 may include more than one LSU such that a first LSU may be utilized in a process of forming an image on a recording medium, and a second LSU may be utilized in a process of reading and/or writing data to the optical tag 1080 provided on a surface of an organic photoconductor 21. The first LSU may direct light to a central portion of the organic photoconductor 21 corresponding to a location of a path of the recording medium during an image forming job. Here, the central portion of the organic photoconductor refers to a central portion along an axial direction of the organic photoconductor 21. The second LSU may direct light to one or both outer portions of the organic photoconductor 21 corresponding to a location outside of the path of the recording medium during the image forming job, along the axial direction of the organic photoconductor 21. The first and second LSU may be provided adjacent to one another along an axial direction of the organic photoconductor 21, may be stacked in a vertical direction of the image forming apparatus 1000, or may be provided in different locations of the image forming apparatus 1000 so long as each LSU can direct light to the portions of the organic photoconductor 21 as needed and so that the second LSU can perform a read operation, for example based on reflected light received by a photocell of the second LSU.

A transfer roller 5 is an example of a transfer unit that is located to face the photosensitive drum 21 to form a transfer nip. A transfer bias voltage used to transfer a toner image developed on the surface of the photosensitive drum 21 to a print medium P is applied to the transfer roller 5. Instead of the transfer roller 5, a corona transfer unit may be used.

The toner image transferred to a surface of the print medium P via the transfer roller 5 is maintained on the surface of the print medium P due to an electrostatic attractive force. A fusing or fixing unit 6 fuses the toner image on the print medium P by applying heat and pressure to the toner image, thereby forming a permanent print image on the print medium P.

Referring to FIG. 2, the development cartridge 2 according to an example includes a developing portion 210 in which the photosensitive drum 21 and the developing roller 22 are mounted, a waste toner container 220 receiving waste toner removed from the photosensitive drum 21, and a toner container 230 connected to the developing portion 210 and containing toner. The development cartridge 2 may be an integrated type development cartridge including the developing portion 210, the waste toner container 220, and the toner container 230.

A portion of an outer circumference of the photosensitive drum 21 is exposed outside a housing. A transfer nip is formed as the transfer roller 5 contacts an exposed portion of the photosensitive drum 21. At least one conveying member conveying toner towards the developing roller 22 may be installed in the developing portion 210. The conveying member may also perform a function of charging toner to a certain electric potential by agitating the toner.

The waste toner container 220 is located above the developing portion 210. The waste toner container 220 is spaced apart from the developing portion 210 in an upward direction to form a light path 250 therebetween. Waste toner removed from the photosensitive drum 21 by using the cleaning member 26 is received in the waste toner container 220. The waste toner removed from the surface of the photosensitive drum 21 is fed into the waste toner container 220 via a waste toner feeding member 221, 222, and 223. The shape and number of waste toner feeding members are not limited. An appropriate number of waste toner feeding members may be installed at appropriate locations to distribute waste toner effectively in the waste toner container 220 by considering a volume or shape of the waste toner container 220.

The toner container 230 may receive or store toner. The toner container 230 is connected to the developing portion 210 via a toner supplier 234 as denoted by a dotted line illustrated in FIG. 2. As illustrated in FIG. 2, the toner supplier 234 may pass through the waste toner container 220 vertically to be connected to the developing portion 210. The toner supplier 234 is located outside an effective width of exposed light L such that the toner supplier 234 does not interfere with the exposed light L scanned in a main scanning direction by using the optical scanner 4.

Toner supplying members 231, 232, and 233 used to supply toner to the developing portion 210 through the toner supplier 234 may be installed in the toner container 230. The shape and number of toner supplying members are not limited. An appropriate number of toner supplying members may be installed at appropriate locations to supply toner effectively to the developing portion 210 by considering a volume or shape of the toner container 230. The toner supplying member 233 may convey toner in a main scanning direction to transfer the same to the toner supplier 234.

An image forming process according to the above-described configuration will be described briefly. A charge bias is applied to the charging roller 23, and the photosensitive drum 21 is charged to a uniform electric potential. The optical scanner 4 scans light modulated in accordance with image information, onto the photosensitive drum 21, thereby forming an electrostatic latent image on a surface of the photosensitive drum 21. The supplying roller 24 attaches the toner to a surface of the developing roller 22. The regulating member 25 forms a toner layer having a uniform thickness on the surface of the developing roller 22. A developing bias voltage is applied to the developing roller 22. As the developing roller 22 is rotated, toner conveyed to a developing nip is moved and attached to the electrostatic latent image formed on the surface of the photosensitive drum 21 via the developing bias voltage, thereby forming a visible toner image on the surface of the photosensitive drum 21. The print medium P withdrawn from a loading tray 7 via a pickup roller 71 is fed, via a feeding roller 72, to the transfer nip where the transfer roller 5 and the photosensitive drum 21 face each other. When a transfer bias voltage is applied to the transfer roller 5, the toner image is transferred to the print medium P via an electrostatic attractive force. As the toner image transferred to the print medium P receives heat and pressure from the fusing unit 6, the toner image is fused to the print medium P, thereby completing printing. The print medium P is discharged by using a discharge roller 73. The toner that is not transferred to the print medium P but remains on the surface of the photosensitive drum 21 is removed by using the cleaning member 26.

As described above, the development cartridge 2 supplies the toner contained in the toner container 230 to the electrostatic latent image formed on the photosensitive drum 21 to form a visible toner image, and is attachable to/detachable from the main body 1. The photosensitive drum 21 may be provided separately from the development cartridge 2 such that the photosensitive drum 21 may be removably mounted to the development cartridge 2, or the photosensitive drum 21 may be integrated with the development cartridge 2. The photosensitive drum 21 may be provided separately from the main body 1 such that the photosensitive drum 21 may be removably mounted to the main body 1, or the photosensitive drum 21 may be integrated with the main body 1.

Figure 3:
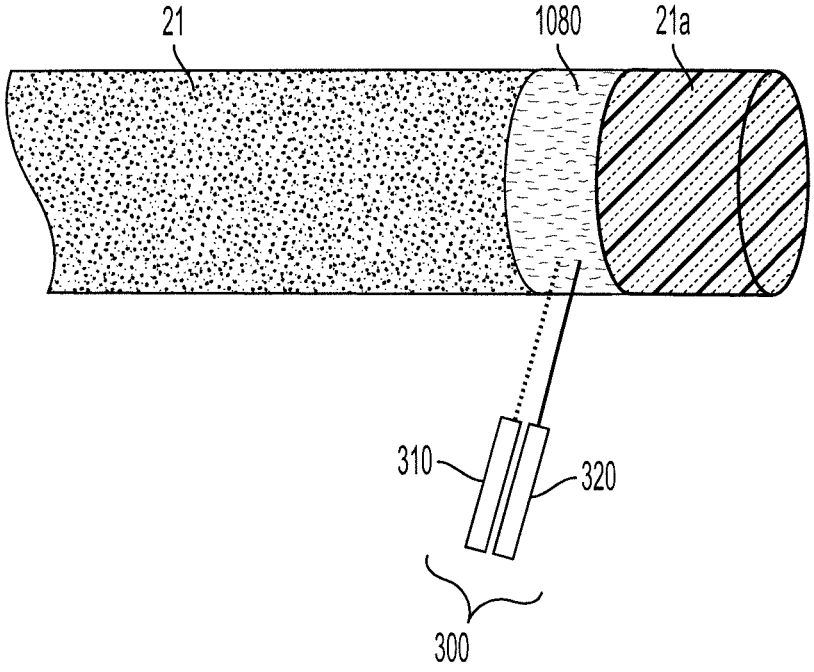
FIG. 3 is a partial view of a photoconductor having an optical tag provided thereon, and an optical system, according to an example.

FIG. 3 is a partial view of a photoconductor 21 having the optical tag 1080 provided thereon, and an optical system 300, according to an example. Referring to FIG. 3, the photoconductor 21 may have a null area or cap 21*a* provided at a distal end of the photoconductor 21 to cover an end of the photoconductor 21. The distal end of the photoconductor 21 may be connected to a driving mechanism for example. The driving mechanism may include a gear 810 (see FIG. 8) which rotates the photoconductor 21. The driving mechanism may further include a motor 820 (see FIG. 8), for example. The gear 810 may be driven by the motor 820 to rotate the photoconductor 21. The photoconductor 21 may be rotated at a predetermined speed according to a control signal transmitted from the controller 1010. The optical tag 1080 may be provided on an outer circumferential surface of the photoconductor 21. For example, the optical tag 1080 may be provided on an outer circumferential surface of the photoconductor 21 at an end of the photoconductor 21, for example a distal end of the photoconductor 21. The optical tag 1080 may be provided at one end or both ends of the photoconductor 21 according to an example.

The optical tag 1080 serves to store data or information. Therefore, a width of the optical tag 1080 may be selected according to how much data or information is to be stored in the optical tag 1080. A larger width of the optical tag 1080 increases the amount of data that can be stored in the optical tag 1080. The width of the optical tag 1080 may be determined by a size of the recording medium to be processed by the image forming apparatus in that the optical tag 1080 may be provided on the photoconductor 21 at a location outside of the path of the recording medium. The optical tag 1080 may be provided as a band to be disposed completely around the photoconductor 21 or partially around the photoconductor 21. A diameter of the photoconductor 21 may also affect how much data or information is to be stored in the optical tag 1080. A larger diameter of the photoconductor 21 increases the area of the optical tag 1080 and therefore increase the amount of data that can be stored in the optical tag 1080.

The optical tag 1080 may include a read-only surface from which data stored in the optical tag 1080 is readable by an optical device, or the optical tag may include a read-write surface from which data stored in the optical tag 1080 is readable by the optical device and to which data can be written from the optical device to the optical tag 1080.

The data which can be written to the optical tag 1080 or read from the optical tag 1080 may include, for example, authentication data, use information relating to the photoconductor 21, the development cartridge 2, or the image forming apparatus 1000, or job information relating to an image forming job performed by the image forming apparatus 1000. Authentication data may be used to determine whether the photoconductor 21 is a valid and authorized photoconductor usable with the image forming apparatus 1000. Use information and job information may include a number of pages printed, duration of print jobs, color usage, types of printing jobs performed (such as duplex printing jobs or simplex printing jobs, high quality or fast printing jobs, collated or uncollated, etc.), and the like. The use information and job information may be categorized according to a user of the image forming apparatus 1000. The disclosure is not limited to the example types of data and other data may be stored and/or read from the optical tag 1080.

Data can be read from the optical tag 1080 and output at the image forming apparatus 1000, for example. The data may be output by the display 1020 and/or user interface 1030, for example. Data can be read from the optical tag 1080 and the image forming apparatus 1000 can transmit the data to an external device such as a server, for example, via the communication interface 1060. The data may be analyzed at the external device for various applications, such as warranty coverage analysis, troubleshooting and diagnosis, and management of the image forming apparatus 1000. Updates to the software or firmware of the image forming apparatus 1000 may also be carried out based on the data read out from the optical tag 1080.

By way of analogy, an example CD-ROM data density p is approximately 48.25 megabytes per square inch. As an example, a one inch diameter organic photoconductor 21 having a one-fourth inch wide optical tag may store about 37 megabytes of data. That is, in the example the optical tag has a width of one-fourth inch, and a length of about 3.14 inches, resulting in an area of 0.785 square inches. Multiplying the area by the density p of 48.25 megabytes per square inch results in an estimated data storage capability of about 37 megabytes of data. That is, the area of the optical tag may be determined by $2\pi*r*$(width of the strip), where r is the radius of the organic photoconductor 21 and the width of the strip is measured in the axial or longitudinal direction of the organic photoconductor 21. The theoretical data storage capability may be equal to the area of the optical tag multiplied by the data density p of the optical tag.

As shown in FIG. 3, an optical device 1070 may include a first laser 310 which writes data to the optical tag 1080 and a second laser 320 which reads data from the optical tag 1080. A lase for the optical device 1070 may be a semiconductor diode laser, for example. The laser may emit infrared light, for example. A wavelength of the laser may be from 600 to 800 nm. For example, the wavelength of the laser may be about 750 nm. The first laser 310 may write data to the optical tag 1080 by emitting light at a first intensity and the second laser 320 may read data from the optical tag 1080 by emitting light at a second intensity, where the second intensity is less than the first intensity. The data which is read from the optical tag 1080 may be transmitted to the controller 1010 or print engine as the data is read from the optical tag 1080. Additionally, data may be transmitted to the optical tag 1080 from the controller 1010 or print engine for the write procedure. Reading and writing of data may be performed simultaneously, for example. Reading and writing of data may be performed in a manner similar to reading and writing operations for a compact disc, for example.

Figure 4:
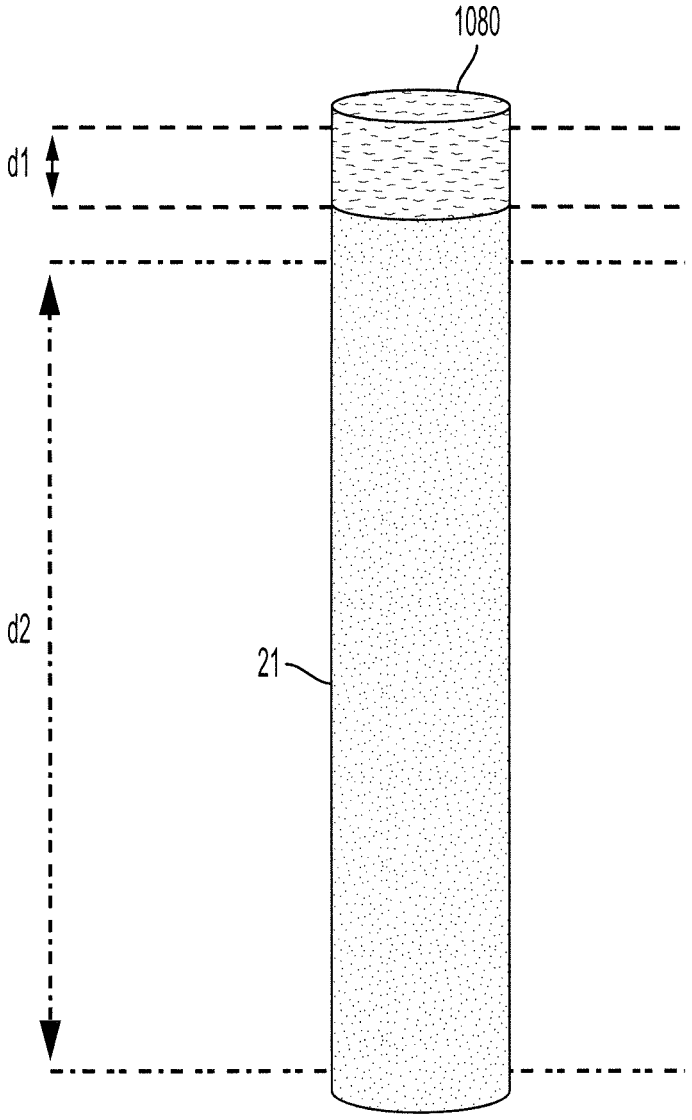
FIG. 4 is a view of a photoconductor having an optical tag provided thereon, according to an example.

FIG. 4 is a view of a photoconductor 21 having an optical tag 1080 provided thereon, according to an example. Referring to FIG. 4, the photoconductor 21 may have an overall length in the axial or longitudinal direction of the photoconductor 21 of about 9 to 13 inches. The optical tag 1080 may have a length in the axial or longitudinal direction of the photoconductor 21 of about ¼ to 1 inch. However, the disclosure is not limited to these examples, and the photoconductor 21 and optical tag 1080 may have different lengths and may be shorter or longer than the example measurements disclosed herein. The portion of the photoconductor 21 which is utilized for an image forming job to transfer toner to a recording medium is denoted by d2 in FIG. 4, for example. The portion of the photoconductor 21 which includes the optical tag 1080 is denoted by d1 in FIG. 4, for example.

FIGS. 5A to 7 are illustrations of example manufacturing processes for providing an optical tag 1080 on an outer circumferential surface of the photoconductor 21.

Figure 5A:
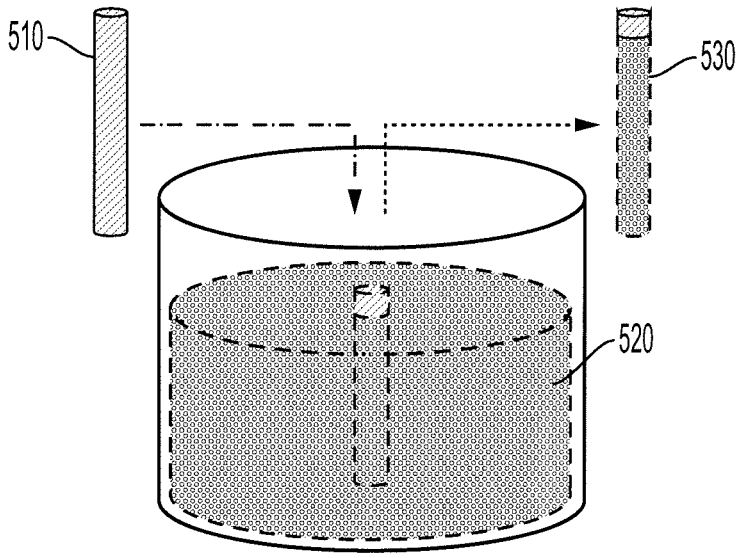
FIGS. 5A and 5B are views of a manufacturing process for a photoconductor, according to an example.
Figure 5B:
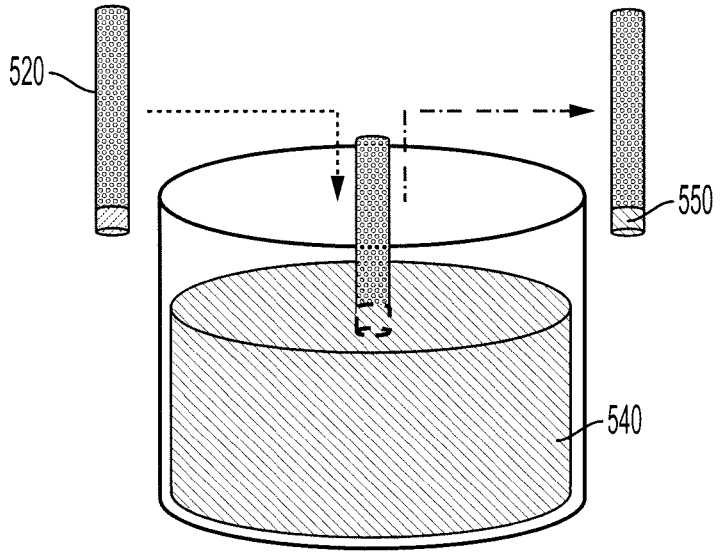

FIGS. 5A and 5B are views of a manufacturing process for a photoconductor, according to an example. Referring to FIG. 5A, the photoconductor 21 may include a metal core 510 which is in the form of a cylinder. The metal core 510 may be an aluminum substrate, for example. The photoconductor 21 may be manufactured by applying a layer 530 of a material 520 on a portion of the photoconductor 21.

Referring to FIG. 5B, subsequent to the application of layer 530, the optical tag 1080 may be formed by applying a layer 550 of a material 540 on another portion, for example a remaining portion, of the photoconductor 21.

It will be understood that the above processes may be performed in a reverse manner. That is, the optical tag 1080 may be formed by applying the layer 550 of the material 540 on a portion of the photoconductor, and then layer 530 of material 520 may be applied to another portion, for example a remaining portion, of the photoconductor 21.

Figure 6:
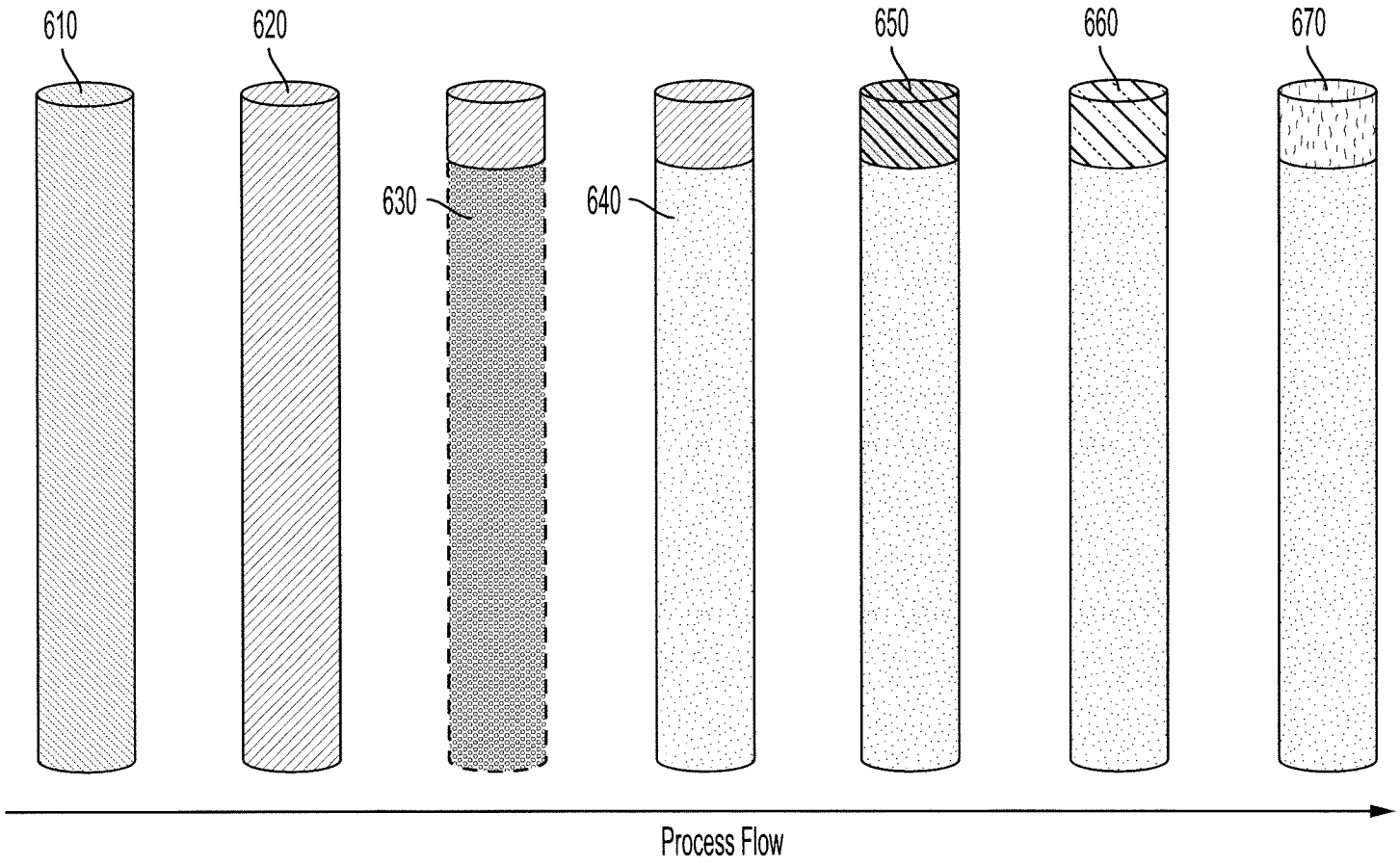
FIG. 6 illustrates a process flow for manufacturing a photoconductor having an optical tag, according to an example.

FIG. 6 illustrates a process flow for manufacturing a photoconductor 21 having the optical tag 1080 is described, according to an example. In FIG. 6, the optical tag 1080 to be manufactured is analogous to a CD-R in that the optical tag 1080 may be written once and read a number of times. The photoconductor 21 may include a metal core 610 which is in the form of a cylinder. The metal core 610 may be an aluminum substrate, for example. A blocking layer 620 may be applied to the aluminum substrate 610, for example along the entire length of the aluminum substrate 610. Thereafter, a charge generation layer 630 may be applied to the blocking layer 620, for example, to a portion of the blocking layer 620. Next, a charge transport layer 640 may be applied to the charge generation layer 630, with a portion of the blocking layer 620 still being an uppermost layer at a portion of the photoconductor 21. The combination of the aluminum substrate 610, blocking layer 620, charge generation layer 630, and charge transport layer 640 corresponds to the portion of the photoconductor 21 which is utilized to perform an image forming job. To form the optical tag 1080 at the end portion of the photoconductor, a dye layer 650 is applied to the blocking layer 620 which remains an uppermost layer at the end portion of the photoconductor 21. Next, a reflective layer 660 is applied to the dye layer 650, and finally a protective layer 670 is applied to the reflective layer. The dye layer 650 may be a photosensitive material that is normally translucent and changes to opaque when heated by light. The dye layer 650 may be an organic dye layer. As example materials, the dye layer 650 may include cyanine, phthalocyanine, azo, or combinations thereof. As example materials, the reflective layer 660 may include aluminum, silver, gold, silver alloy, or combinations thereof. As example materials, the protective layer 670 may include polycarbonate, polycarbonate plastics, acrylic, lacquer, or combinations thereof.

The combination of the aluminum substrate 610, blocking layer 620, dye layer 650, reflective layer 660, and protective layer 670, corresponds to the optical tag 1080 which is utilized to store data, and from which an optical device 1070 can read data from the optical tag 1080. The optical device 1070 can transmit data read from the optical tag 1080 to the controller 1010 which can be used in connection with performance of a function of the image forming apparatus.

As another example, the application of the dye layer 650, reflective layer 660, and protective layer 670 may be performed before the charge generation layer 630 and charge transport layer 640 are applied to the blocking layer 620.

Figure 7:
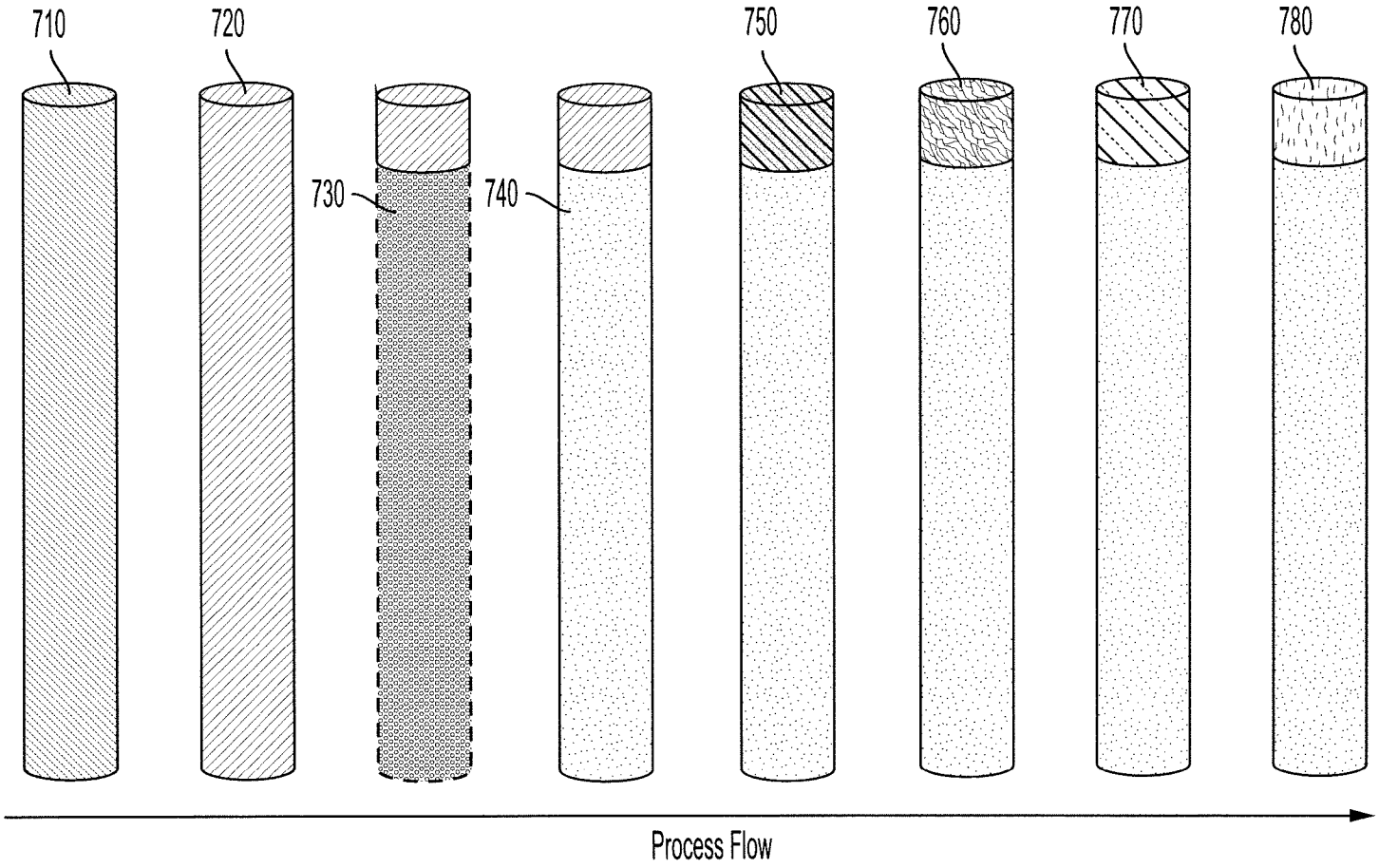
FIG. 7 illustrates a process flow for manufacturing a photoconductor having an optical tag, according to an example.

FIG. 7 illustrates a process flow for manufacturing a photoconductor 21 having the optical tag 1080 is described, according to an example. In FIG. 7, the optical tag 1080 to be manufactured is analogous to a CD-RW in that data can be written to the optical tag 1080, read from the optical tag 1080, and erased from the optical tag 1080. The photoconductor 21 may include a metal core 710 which is in the form of a cylinder. The metal core 710 may be an aluminum substrate, for example. A blocking layer 720 may be applied to the aluminum substrate 710, for example along the entire length of the aluminum substrate 710. Thereafter, a charge generation layer 730 may be applied to the blocking layer 720, for example, to a portion of the blocking layer 720. Next, a charge transport layer 740 may be applied to the charge generation layer 730, with a portion of the blocking layer 720 still being an uppermost layer at a portion of the photoconductor 21. The combination of the aluminum substrate 710, blocking layer 720, charge generation layer 730, and charge transport layer 740 corresponds to the portion of the photoconductor 21 which is utilized to perform an image forming job. To form the optical tag 1080 at the end portion of the photoconductor, a dielectric film 750 is applied to the blocking layer 720 which remains an uppermost layer at the end portion of the photoconductor 21. Next, a phase change material 760 is applied to the dielectric film 750, a reflective layer 770 is applied to the phase change material 760, and finally a protective layer 780 is applied to the reflective layer 770. As example materials, the dielectric film 750 may include zinc sulfide, silicon dioxide, or combinations thereof. The phase change material 760 may include materials having at least two phases of different reflectivity. As example materials, the phase change material 760 may include indium, silver, tellurium, antimony, or combinations thereof. As example materials, the reflective layer 770 may include aluminum, silver, gold, or combinations thereof. As example materials, the protective layer 780 may include polycarbonate, polycarbonate plastics, acrylic, lacquer, or combinations thereof.

The combination of the aluminum substrate 710, blocking layer 720, dielectric film 750, phase change material 760, reflective layer 770, and protective layer 780, corresponds to the optical tag 1080 which is utilized to store data, and from which an optical device 1070 can read data from the optical tag 1080, write data to the optical tag 1080, and erase data from the optical tag 1080. The optical device 1070 can transmit data read from the optical tag 1080 to the controller 1010 which can be used in connection with performance of a function of the image forming apparatus.

As another example, the application of the dielectric film 750, phase change material 760, reflective layer 770, and protective layer 780 to the end portion of the blocking layer 720 may be performed before the charge generation layer 730 and charge transport layer 740 are applied to the blocking layer 720.

Figure 8:
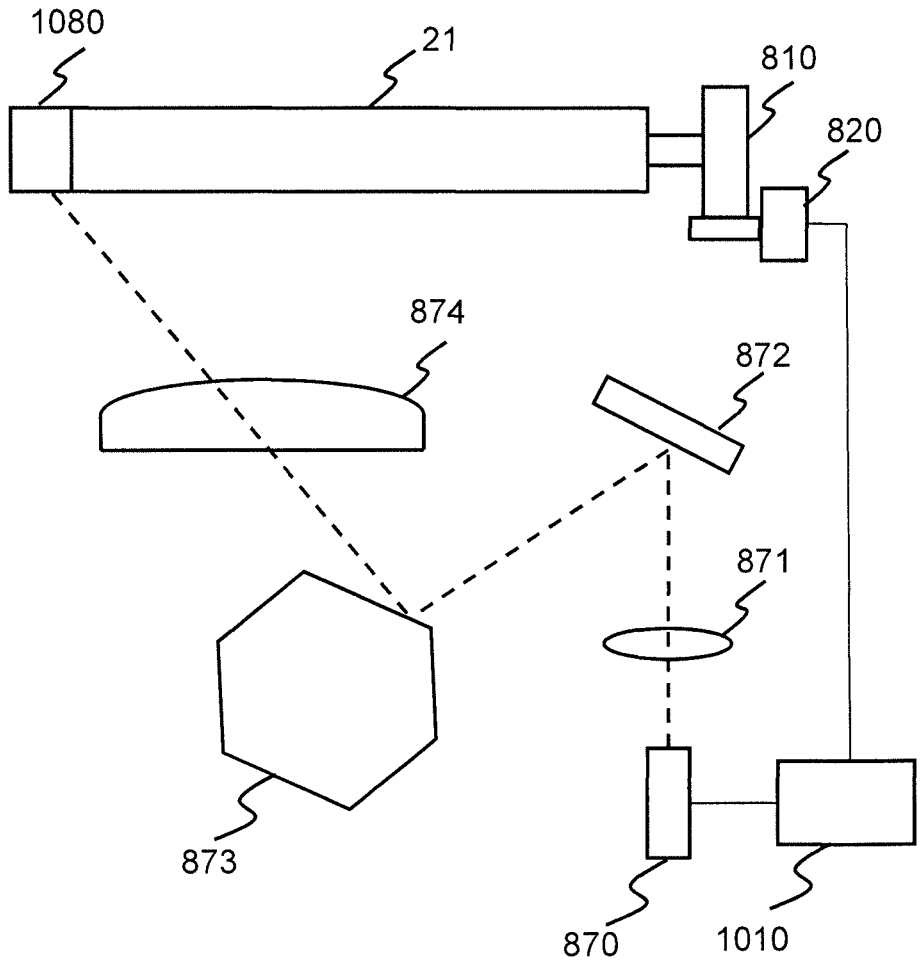
FIG. 8 illustrates an optical system to read and/or write data to an optical tag provided on a photoconductor, according to an example.
Figure 9:
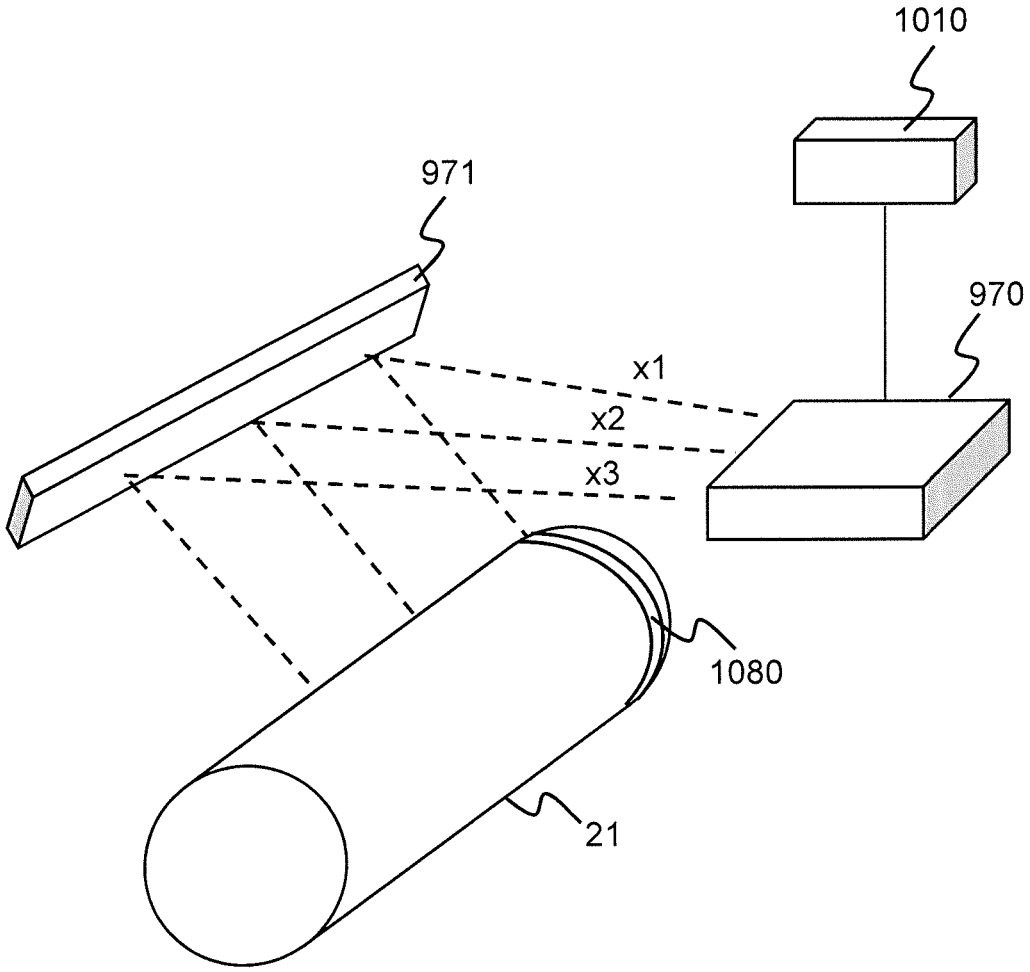
FIG. 9 illustrates an optical system to read and/or write data to an optical tag provided on a photoconductor, according to an example.

FIGS. 8 and 9 are example illustrations of optical systems to read and/or write data to an optical tag provided on a photoconductor.

Referring to FIG. 8, the image forming apparatus may include the controller 1010 which controls optical device 870 that emits light to optical tag 1080. The optical device 870 may be located in any location within the image forming apparatus so long as the line of sight or optical path to the optical tag 1080 is free from interference. In the example of FIG. 8, the light path may travel from the optical device 870 through a lens 871, be reflected by mirrors 872 and 873 and pass through lens 874 before reaching optical tag 1080. Lens 871 may be a collimating lens, for example. Mirror 873 may be a polygonal mirror, for example. Lens 874 may be a cylindrical lens, for example. The optical device 870 may be utilized for reading data from optical tag 1080 and/or writing data to optical tag 1080. For example, the photoconductor 21 may be rotated by a control of the controller 1010 at a predetermined speed for reading and/or writing data to the optical tag 1080. As another example, the optical device 870 may also be used for image formation for performing an image forming job.

Referring to FIG. 9, the image forming apparatus may include the controller 1010 which controls optical device 970 that emits light to optical tag 1080. The optical device 970 may be located in any location within the image forming apparatus so long as the line of sight or optical path to the optical tag 1080 is free from interference. In the example of FIG. 9, the light path x1 may travel from the optical device 970 and be reflected by mirror 971 before reaching optical tag 1080. The optical device 970 may be utilized for reading data from optical tag 1080 and/or writing data to optical tag 1080. For example, the photoconductor 21 may be rotated via a gear and motor by a control of the controller 1010 at a predetermined speed for reading and/or writing data to the optical tag 1080. As another example, the optical device 970 may also be used for image formation for performing an image forming job. For example, the optical device 970 may transmit light via optical paths x2 and x3 onto a surface of the photoconductor which is used for performing the image forming job.

As described herein, a photoconductor having an optical tag is used to increase or replace an available data storage for an image forming apparatus. An optical system is used to read and write data to the optical tag. The optical system may be used for both image formation and for storing and reading data from the optical tag, or a separate optical system may be provided for use with the optical tag. Storing data in the optical tag may reduce overall costs of the image forming apparatus and/or development cartridge. A size of the optical tag may be selected based on an amount of data to be stored. Therefore, an improved user experience may be obtained in connection with the use of the photoconductor having the optical tag, and the image forming apparatus as described herein.

While various examples have been described with reference to the drawings, it will be understood that various changes in form and details may be made therein without departing from the spirit and scope as defined by the following claims.

What is claimed is:

1. A photoconductor comprising:

a cylindrical body having a surface on which an electrostatic latent image is to be formed; and an optical tag provided on an outer circumferential surface of the cylindrical body, wherein the optical tag comprises a dye layer and a reflective layer.

2. The photoconductor of claim 1, wherein the optical tag is provided at an end of the cylindrical body.

3. The photoconductor of claim 1, wherein the optical tag includes a read-write surface to which data is writable from an optical device to the optical tag.

4. The photoconductor of claim 1, wherein the cylindrical body includes a plurality of layers, the plurality of layers comprising:

a blocking layer provided along an entire length of the cylindrical body, a charge generation layer provided along a first portion of the length of the cylindrical body, and a charge transport layer provided along the first portion of the length of the cylindrical body.

5. The photoconductor of claim 4, wherein the plurality of layers comprise:

the dye layer, the reflective layer, and a protective layer provided along a remaining portion of the length of the cylindrical body.

6. A development cartridge, comprising:

the photoconductor of claim 1; and a developing roller to transfer toner to the electrostatic latent image formed on the surface of the cylindrical body to form a visible toner image on the surface of the cylindrical body.

7. The development cartridge of claim 6, wherein the cylindrical body includes a plurality of layers, the plurality of layers comprising:

a blocking layer provided along a length of the cylindrical body, a charge generation layer provided along a first portion of the length of the cylindrical body, and a charge transport layer provided along the first portion of the length of the cylindrical body.

8. The development cartridge of claim 7, wherein the plurality of layers comprise:

the dye layer, the reflective layer, and a protective layer provided along a remaining portion of the length of the cylindrical body.

9. The development cartridge of claim 6, wherein:

the optical tag is to store data, the data including at least one of authentication data, use information relating to the photoconductor, or job information relating to an image forming job performed using the development cartridge, and the optical tag includes:

a read-only surface from which data stored in the optical tag is readable by an optical device, or a read-write surface from which data stored in the optical tag is readable by the optical device and to which data can be written from the optical device to the optical tag.

10. A photoconductor comprising:

a cylindrical body having a surface on which an electrostatic latent image is to be formed; and an optical tag provided on an outer circumferential surface of the cylindrical body, wherein the optical tag comprises a dielectric film, a phase change material, and a reflective layer.

11. The photoconductor of claim 10, wherein the cylindrical body includes a plurality of layers, the plurality of layers comprising:

a blocking layer provided along a length of the cylindrical body, a charge generation layer provided along a first portion of the length of the cylindrical body, and a charge transport layer provided along the first portion of the length of the cylindrical body.

12. The photoconductor of claim 11, wherein the plurality of layers further comprise:

the dielectric film, the phase change material, the reflective layer, and a protective layer provided along a remaining portion of the length of the cylindrical body.

13. An image forming apparatus comprising:

a main body;

a photoconductor comprising:

a cylindrical body having a surface on which an electrostatic latent image is to be formed, and an optical tag provided on an outer circumferential surface of the cylindrical body; and an optical device to emit a first light to write data to the optical tag, and to emit a second light to read the data from the optical tag.

14. The image forming apparatus of claim 13, wherein the second light has an intensity less than the first light.

15. The image forming apparatus of claim 13, wherein the data to be read from the optical tag and/or the data to be written to the optical tag includes at least one of authentication data, use information relating to the photoconductor, or job information relating to an image forming job performed by the image forming apparatus.

16. The image forming apparatus of claim 13, wherein the optical tag comprises a dye layer and a reflective layer.

17. The image forming apparatus of claim 13, wherein the optical tag comprises a dielectric film, a phase change material, and a reflective layer.

18. A method for manufacturing a photoconductor, comprising:

providing a cylindrical body;

applying a blocking layer along an entire length of the cylindrical body;

applying at least one of a charge generation layer and a charge transport layer along a first portion of the length of the cylindrical body; and providing an optical tag on an outer circumferential surface of a remaining portion of the length of the cylindrical body, the optical tag comprising a read-write surface on which data is writable based on a first light emitted by an optical device, and from which data is readable based on a second light emitted by the optical device.

19. The method of claim 18, wherein providing the optical tag comprises:

applying a dye layer, a reflective layer, and a protective layer along the remaining portion of the length of the cylindrical body.

20. The method of claim 18, wherein providing the optical tag comprises:

applying a dielectric film, a phase change material, a reflective layer, and a protective layer along the remaining portion of the length of the cylindrical body.

* * * * *